US006712547B1

(12) United States Patent
Shauf, Sr. et al.

(10) Patent No.: US 6,712,547 B1
(45) Date of Patent: Mar. 30, 2004

(54) MARKER POST, MOLD ASSEMBLY AND MOLDING METHOD

(75) Inventors: Mitchell Earl Shauf, Sr., Gainesville, TX (US); Nelson C. Newton, Valley View, TX (US)

(73) Assignee: Petroflex, N.A., Inc., Gainesville, TX (US)

( * ) Notice: Subject to any disclaimer, the term of this patent is extended or adjusted under 35 U.S.C. 154(b) by 0 days.

(21) Appl. No.: 10/361,113

(22) Filed: Feb. 8, 2003

(51) Int. Cl.[7] ..... E01F 9/00
(52) U.S. Cl. ..... 404/9; 116/63 R
(58) Field of Search ..... 404/6, 9, 10; 116/63 R

(56) References Cited

U.S. PATENT DOCUMENTS 3,572,223 A * 3/1971 Vierregger ..... 52/296
4,078,867 A * 3/1978 Ronden ..... 404/10
5,234,280 A * 8/1993 Cowan ..... 404/6
5,307,598 A * 5/1994 West ..... 52/155
6,305,312 B1 * 10/2001 Bent et al. ..... 116/63 P

* cited by examiner

*Primary Examiner*—Gary S. Hartmann
(74) *Attorney, Agent, or Firm*—Mark E. Brown

(57) ABSTRACT

A marker post comprising an embodiment or aspect of the invention includes a body with upper and lower ends, a bore extending between the ends and a sidewall enclosing the bore. A top panel is mounted on the body upper end and encloses the bore thereat. A base is mounted on the body lower end and includes a perimeter positioned outwardly from the sidewall. An embodiment or aspect of the mold assembly for rotary molding the marker post includes first and second mold halves enclosing a mold cavity with body and base subcavities. In one embodiment or aspect of a marker post manufacturing method of the invention, the body and base are integrally rotary molded in first and second mold halves, which are separated for extracting the rotary-formed marker post.

1 Claim, 5 Drawing Sheets

MARKER POST, MOLD ASSEMBLY AND MOLDING METHOD

BACKGROUND OF THE INVENTION

1. Field of the Invention

The present invention relates generally to marker posts, and in particular to a square marker post and a mold assembly and method for rotary molding same.

2. Discussion of the Related Art

Various utilities are commonly placed underground. Examples include fiber optic cables, electrical power lines, gas lines, water lines, steam pipes, pipelines and other utilities. One reason for installing utility lines below grade relates to security and protection, since they are normally relatively well protected from service interruptions caused by the elements and by damage, both intentional and accidental. Another reason relates to aesthetics. Underground installations can eliminate unsightly utility poles and overhead lines.

The specific locations of underground utility lines can sometimes be approximated from records, such as drawings prepared in connection with their original installations. However, utility companies and other organizations that utilize underground utilities often provide surface markers showing their locations. For example, the prior art includes elongated, vertical marker posts, the lower ends of which are embedded in the ground above the utility lines. The above-grade, exposed upper ends of such marker posts can be provided with markings, which can identify the utility lines buried thereunder and communicate appropriate warnings. For example, subsurface electrical power and natural gas lines tend to be hazardous to excavators, with attendant risks of electrical shock and explosion respectively. Accordingly, marker posts are used to provide appropriate warnings, such as "Call Before Digging" advisories with toll-free numbers at which additional, pertinent information can be obtained.

Subsurface fiber optic and other telecommunications cables are also susceptible to damage from excavators. Severing telecommunications cables can interrupt service unless transmissions can be rerouted. Depending upon the normal traffic volume in a buried cable, significant revenues can be lost before a splice can be made and service restored. Therefore, telecommunications companies naturally attempt to protect their fiber optic cable networks by marking the locations of same with appropriate warnings and information.

Prior art marker posts also include concrete constructions with metal plates mounted adjacent to their upper ends. Warnings and other information can be displayed on the metal plates. Other prior art marker post examples include plastic tubes, which can be provided with transverse lengths of tubing at their lower ends for resisting pullout. Such tubular plastic marker posts can mount upper end caps, which can be printed with warning information and color-coded to designate the type of utility buried thereunder.

Heretofore there has not been available a marker post and an apparatus and method for manufacturing same with the advantages and features of the present invention.

BRIEF DESCRIPTION OF THE INVENTION

In the practice of one aspect of the present invention, a marker post is provided, which comprises a generally tubular body with upper and lower ends, a bore extending between the ends and a sidewall structure enclosing the bore.

A top panel is mounted on the body upper end and encloses the bore thereat. A base is mounted on the body lower end and includes a base perimeter positioned generally outwardly from the sidewall. The base includes a bottom panel mounted on the base perimeter and having an generally aligned with the bore.

BRIEF DESCRIPTION OF THE DRAWINGS

The drawings constitute a part of this specification and include exemplary embodiments of the present invention and illustrate various objects and features thereof.

DETAILED DESCRIPTION OF THE INVENTION

I. Introduction

As required, detailed embodiments and/or aspects of the present invention are disclosed herein; however, it is to be understood that the disclosed embodiments/aspects are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. Marker Post 2

Figure 1:
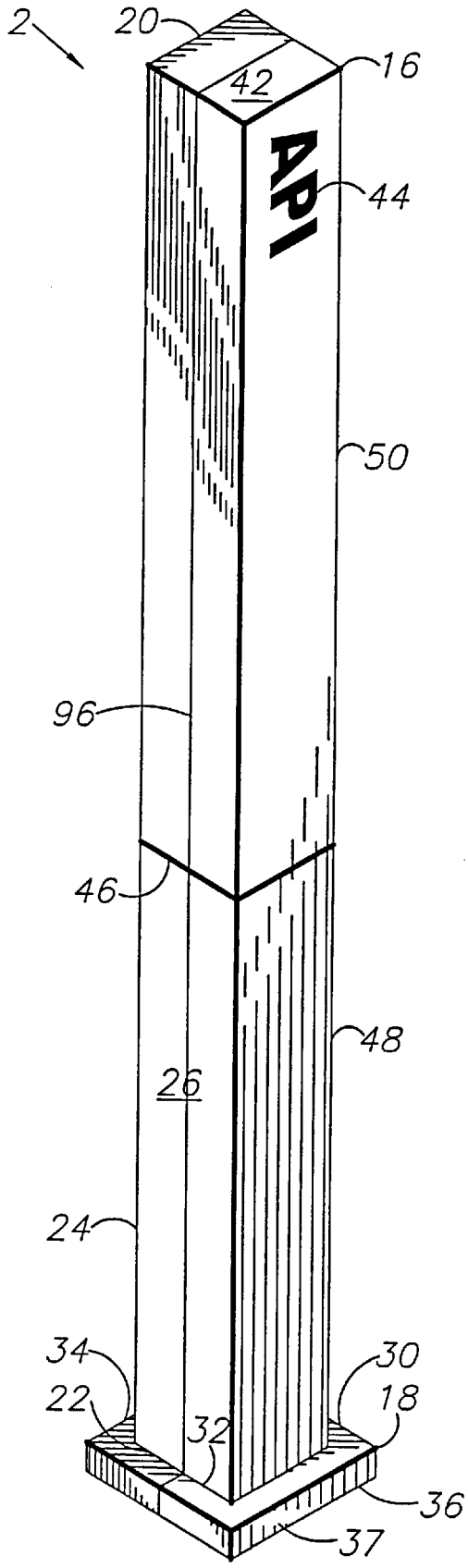
FIG. 1 is an upper perspective view of an embodiment/aspect of the invention.
Figure 2:
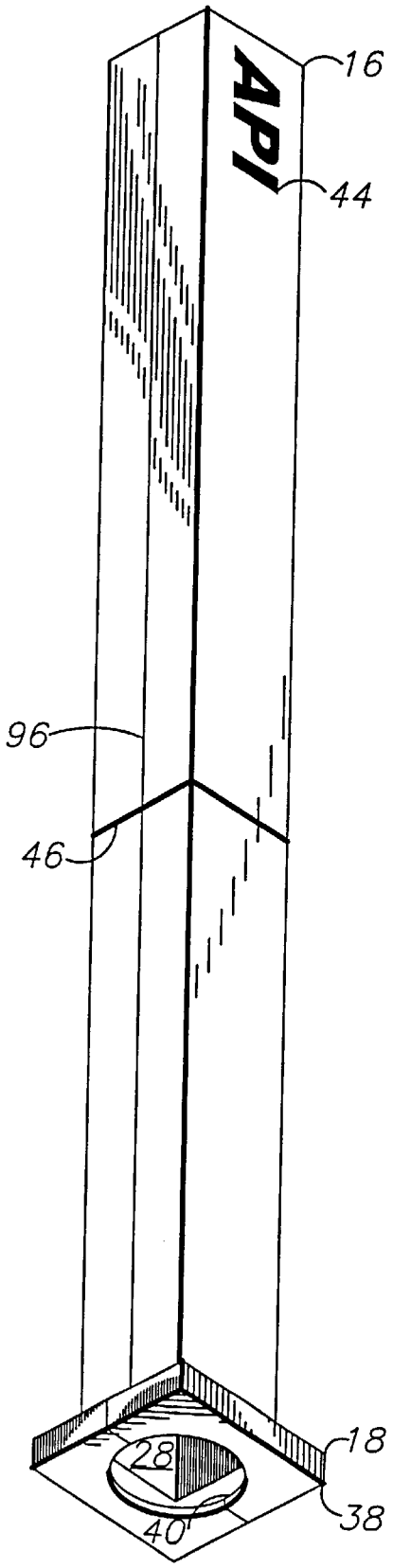
FIG. 2 is a bottom perspective view thereof.
Figure 3:
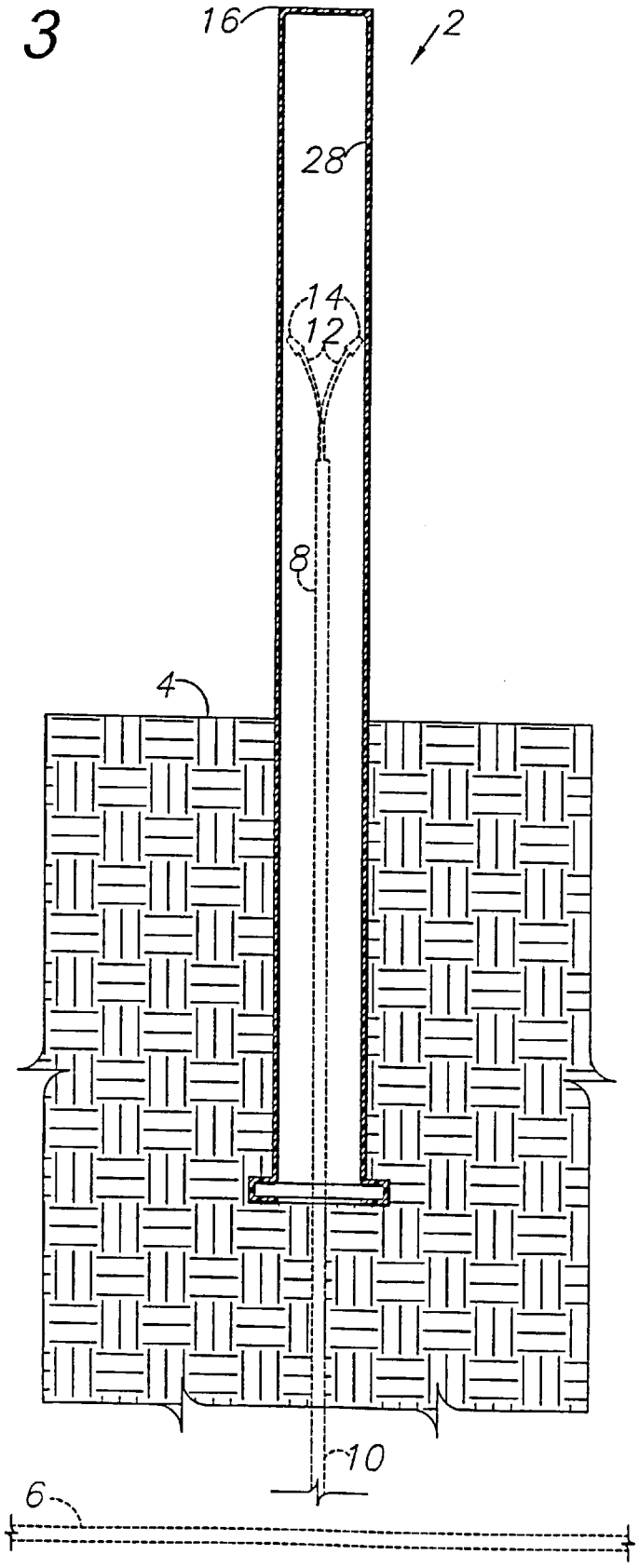
FIG. 3 is a vertical, cross-sectional view thereof, shown partially buried over a utility line, with a utility line extension located in the marker post.

Referring to the drawings in more detail, the reference numeral 2 generally designates a marker post showing one embodiment of the present invention. Without limitation on the generality of useful applications of the invention in its different embodiments, the marker post embodiment 2 as shown in FIG. 3 is partially embedded in earth 4 over a buried, subsurface utility line 6. Optionally, a utility line extension 8 comprising a conduit 10 receiving conductors 12 mounting wire nuts 14 at their ends can be received within the marker post 2. In such an application the marker post 2 protects the utility line extension 8 and marks its location for possible future access and connection. For example, an area under development might include a number of utility line extensions 8 received in respective marker posts 2 whereat utility connections can be made in the future as the area develops.

The marker post 2 generally includes a body 16 and a base 18. The body 16 has an upper end 20 and a lower end 22. The body 16 has a generally square tubular configuration with a sidewall structure 24 comprising four sidewalls 26 enclosing a body bore 28. Although a square tubular body 16 is shown, other aspects of the invention could include rectangular, multi-sided and circular cross-sectional configurations for the body 16.

A top panel 42 is integrally formed with the sidewall structure 24 and encloses the bore 28 at the body upper end 20. A graphical display 44 is provided on a respective sidewall 26 in proximity to the body upper end 20 in one aspect of the invention. In other aspects of the invention graphical displays can be placed at other locations and on one or more sidewalls 26. A ground line 46 is located on one or more of the sidewalls 26 and provides a reference elevation for installing the marker post 2 with a lower portion 48 thereof buried up to the ground line 46 and an upper portion 50 thereof extending upwardly above the existing grade level 52.

The base 18 has a generally square configuration with an upper flange 30 projecting outwardly from the body lower end 22. The upper flange 30 includes a square inner edge 32 integrally connected to the sidewalls 26 at the body lower end 22 and a square outer edge 34. A base perimeter sidewall structure 36 includes four base sidewalls 37 depending downwardly from the flange outer edge 34 in generally parallel, spaced relation from respective body sidewalls 26. A base bottom panel 38 is integrally formed with the base sidewall structure 36 and partially encloses the base 18. The base bottom panel 38 includes a generally circular opening 40 aligned with the bore 28 and having a diameter approximately equal to a cross-dimension of the body bore 28 between respective opposed pairs of sidewalls 26.

Figure 4:
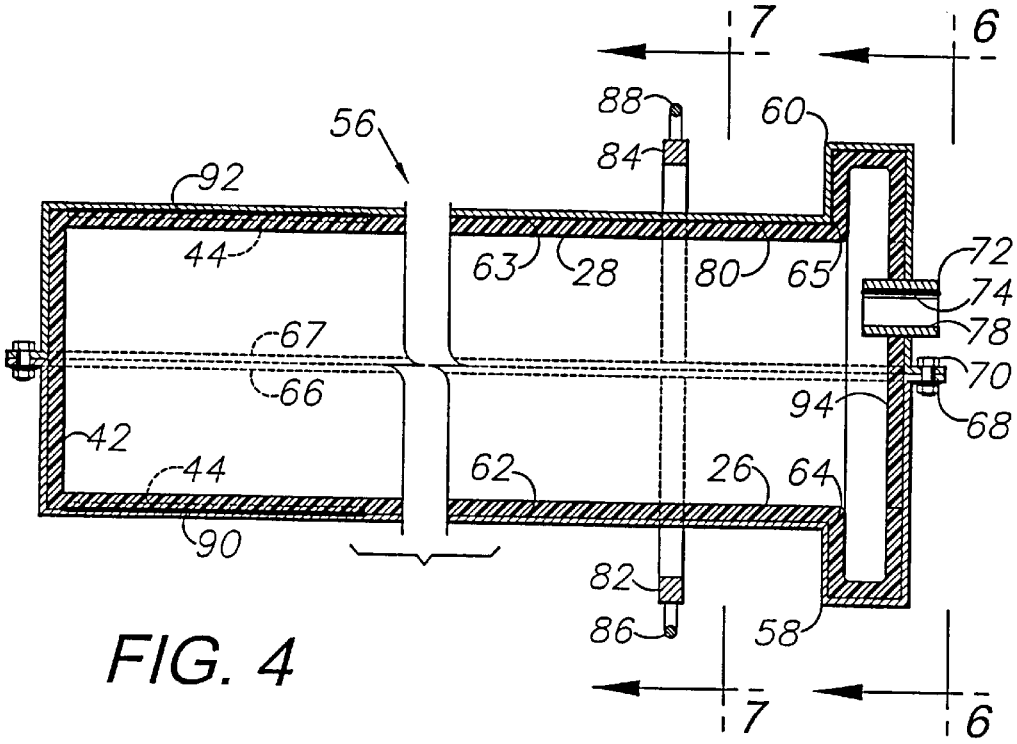
FIG. 4 is a fragmentary, cross-sectional view of the marker post in a rotary mold assembly.
Figure 5:
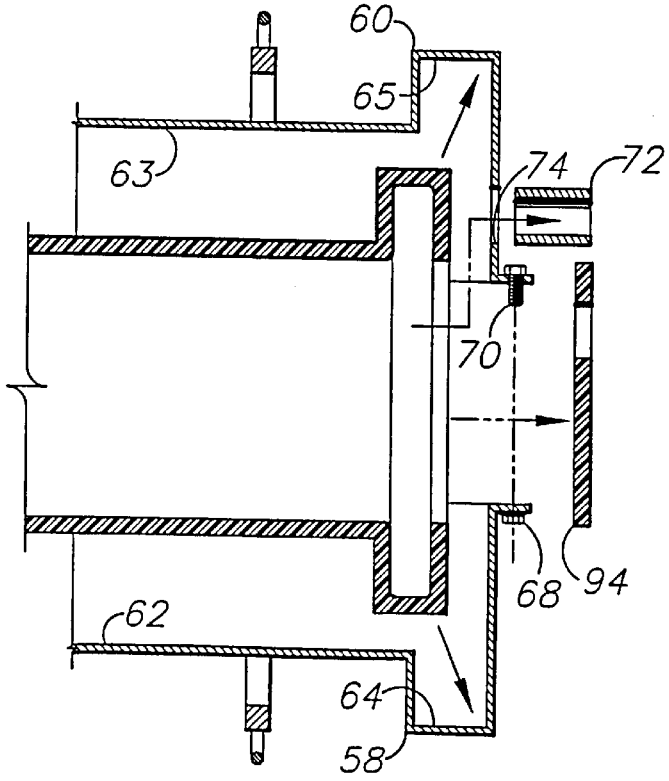
FIG. 5 is a fragmentary, cross-sectional view thereof, showing the mold halves removed.
Figure 6:
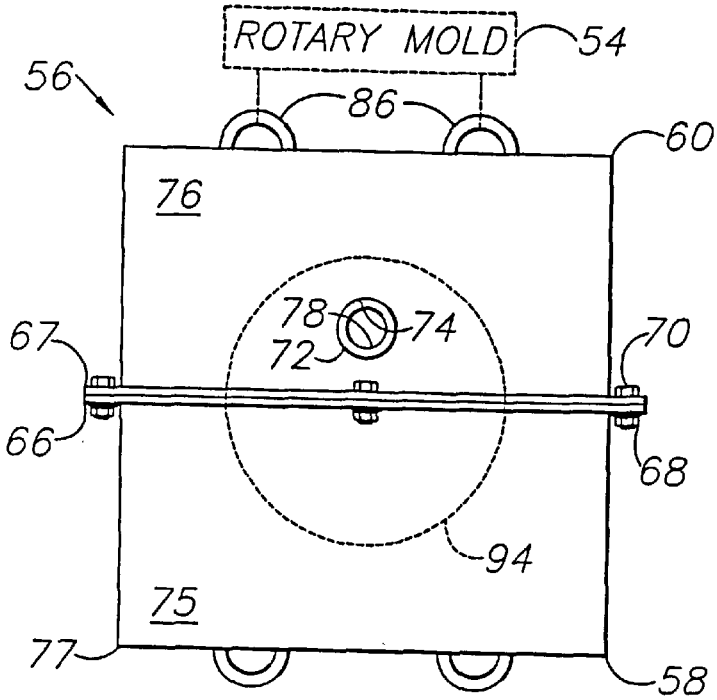
FIG. 6 is an end elevational view thereof, taken generally along line 6—6 in FIG. 4.
Figure 7:
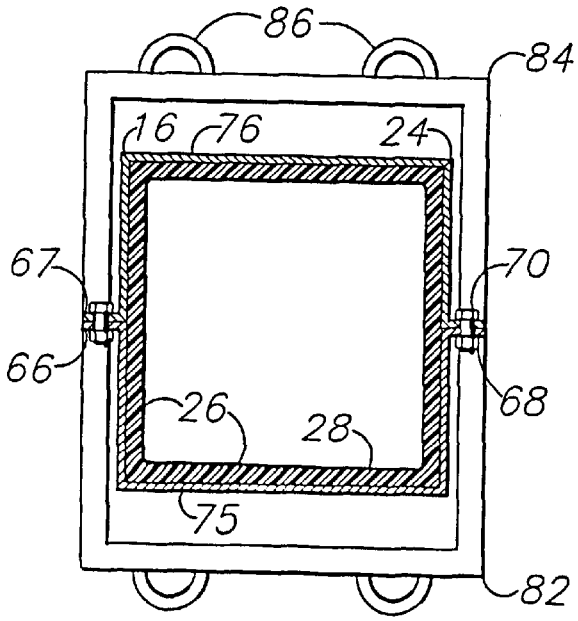
FIG. 7 is a cross-sectional view thereof, taken generally along line 7—7 in FIG. 4.

The components of the marker post 2, i.e. the body 16 and the base 18, can be integrally formed by rotary molding in one aspect of the invention. The material can comprise any suitable plastic or other material, such as linear low density polyethylene (LLDP). Rotary molding can be accomplished with a rotary molder 54, which mounts a mold assembly 56 on a rotating arm thereof. The mold assembly 56 includes a mold cavity 80 and first and second mold halves 58, 60 each forming a respective body cavity 62, 63 and a respective base cavity 64, 65, which cavities generally and collectively conform to the configuration of the finished marker post 2 (FIGS. 4 and 5). Each mold half 58, 60 includes a respective perimeter flange 66, 67. First perimeter flange 66 mounts multiple nuts 68, which can be welded in place and receive bolts 70 extending through the second perimeter flange 67 whereby the mold halves 58, 60, can be bolted together along their respective flanges 66, 67 during the rotary molding process (FIG. 4), and separated for extracting the marker post 2 upon completion of the molding process (FIG. 5). The mold halves 58, 60, also include first and second mold bottom halves 75, 76, which collectively form a mold bottom panel 77 with the mold halves 75, 76 bolted together.

With the mold halves 58, 60 secured together (FIG. 4), a vent tube 72 is placed in a vent tube receiver 74 formed in the mold bottom panel 76 of the second mold half 60. The vent tube 72 forms a passage 78 from a mold cavity 80 to atmosphere for relieving pressure in the mold assembly 56 during rotary molding. The mold halves 58, 60 include respective U-shaped mold spiders or cradles 82, 84 respectively which mount respective lifting lugs 86, 88 for suspending the mold assembly 56 on the rotary molder. The mold spiders or cradles 82, 84 are welded at their respective ends to the respective mold half flanges 66, 67.

The graphical display 44 and the ground line 46 are formed by placing transfer decals 90, 92 respectively in the appropriate moid half 58 and/or 60 whereby pigment transfers into the molten LLDP during the molding process. The body 16, thus infused with the pigment, tends to retain the graphics 44, 46 relatively permanently. In one aspect of the invention, the transfer decals 90, 92 comprise a hindered amine light stabilizer, although other graphical materials can also be utilized.

Upon completion of the molding process and extraction of the molded marker post 2, the bottom opening 40 can be formed by routing a circle 94 out of the bottom panel 38 (FIG. 5). A part line 96 is formed along the body 16 and the base 18 where the mold half perimeter flanges 66, 67 meet and can be ground or sanded smooth to remove mold flashing located thereat. In one aspect of the invention, the mold halves 58, 60 can comprise sheet metal, such as 12 gauge stainless steel. Alternatively, the mold halves can be cast from aluminum or other suitable material.

Is to be understood that while certain embodiments and/or aspects of the invention have been shown and described, the invention is not limited thereto and encompasses various other embodiments/aspects.

What is claimed and desired to be secured by letters patent is as follows:

1. A marker post adapted for partially embedding in the earth, which comprises:

a generally tubular body with upper and lower ends, a bore extending between said ends and a sidewall structure enclosing said bore, said body including four body sidewalls enclosing said bore and a generally square cross-sectional configuration defined by said body sidewalls;

said body having a generally square cross-sectional configuration;

said bore having an internal cross dimension between opposite sidewalls;

said body including a top panel mounted on said body upper end and closing said bore thereat;

a base adapted for burying below grade, said base being mounted on and projecting outwardly from said lower end and including a base perimeter positioned generally outwardly from said body sidewall structure;

said base having a generally square configuration and a generally square upper flange, said upper flange having an inner flange edge integrally connected to and extending generally outwardly from said body sidewalls at said lower end whereby an upper surface of said upper flange is exposed at said body lower end and is generally located in a plane perpendicular to said body;

said base upper flange having an outer flange edge;

a base sidewall structure located at said base perimeter and comprising four base sidewalls integrally connected to and depending downwardly from said upper flange at said outer edge thereof, said base sidewalls being generally parallel to respective body sidewalls;

said base including a generally square bottom panel mounted on said base sidewall structure in generally parallel, spaced relation below said base upper flange;

said base bottom panel having a circular opening therein, said opening being generally aligned with said body bore and having a diameter approximately equal to the bore cross dimension;

said body and said base being integrally formed of linear low density polyethylene (LLDP); and a graphical indicia applied to at least one of said sidewalls in proximity to said body upper end and comprising pigment absorbed into said LLDP.

* * * * *